United States Patent [19]

Gordon

[11] Patent Number: 5,012,959

[45] Date of Patent: May 7, 1991

[54] POUR SPOUT AND CARTON CONSTRUCTION

[75] Inventor: Robert L. Gordon, Monroe, N.Y.

[73] Assignee: International Paper Company, Purchase, N.Y.

[21] Appl. No.: 272,279

[22] Filed: Nov. 17, 1988

[51] Int. Cl.[5] ..... B65D 43/00; B65D 43/16

[52] U.S. Cl. ..... 222/535; 222/541; 220/269; 229/123.3; 229/125.04; 229/125.08; 229/125.14; 229/125.15

[58] Field of Search ..... 222/480, 528, 531, 533–535, 222/541, 556; 229/123.3, 125.04, 125.08, 125.14, 125.15; 206/621.3, 621.4, 621.5; 220/266, 268–270

[56] References Cited

U.S. PATENT DOCUMENTS

| | | | |
|---|---|---|---|
| 2,077,341 | 4/1937 | Martin et al. | 229/125.14 X |
| 2,824,894 | 4/1958 | Zimmerman | 229/125.04 X |
| 2,943,769 | 7/1960 | Klausmann et al. | 222/535 X |
| 3,217,949 | 11/1965 | Davis | 222/480 |
| 3,251,509 | 5/1966 | Foster | 222/556 X |
| 3,266,681 | 8/1966 | Rabb | 222/541 X |
| 3,484,034 | 12/1969 | Sternau | 229/125.04 X |
| 3,966,080 | 6/1976 | Bittel | 220/269 |
| 4,723,693 | 2/1988 | DeCoster | 222/480 X |
| 4,760,938 | 8/1988 | Wenger | 222/531 X |
| 4,775,098 | 10/1988 | Peer, Jr. et al. | 229/125.15 X |
| 4,793,516 | 12/1988 | Niwa et al. | 222/541 X |
| 4,795,065 | 1/1989 | Ashizawa et al. | 220/269 X |

*Primary Examiner*—Kevin P. Shaver
*Attorney, Agent, or Firm*—Michael J. Doyle; Walt Thomas Zielinski

[57] ABSTRACT

A paperboard carton and plastic pour spout fitment construction for cartons adapted to carry powdered or granular material, particularly foodstuffs. A side wall of the carton is provided with a precut opening to receive the separate fitment. The periphery of the sides of the pour spout bottom wall must be broken from the surrounding fitment by the consumer upon initial use, to permit the spout to pivot for dispensing. The spout is thus held against accidental opening during shipping and handling prior to use, and further, such breaking is automatically tamper evident. The fitment is attached to a side wall of the carton by use of an adhesive or by a plurality of rivet stakes integral with the spout. The rivet stakes are received in complementary punctures bordering the precut opening. The use of plastic for the pour spout fitment insures against metal particles contaminating the contents of the carton.

7 Claims, 2 Drawing Sheets

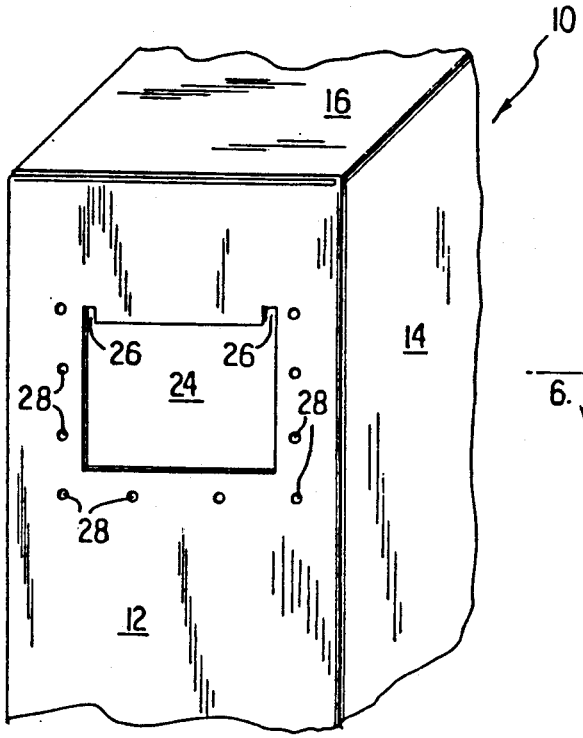
FIG. 1
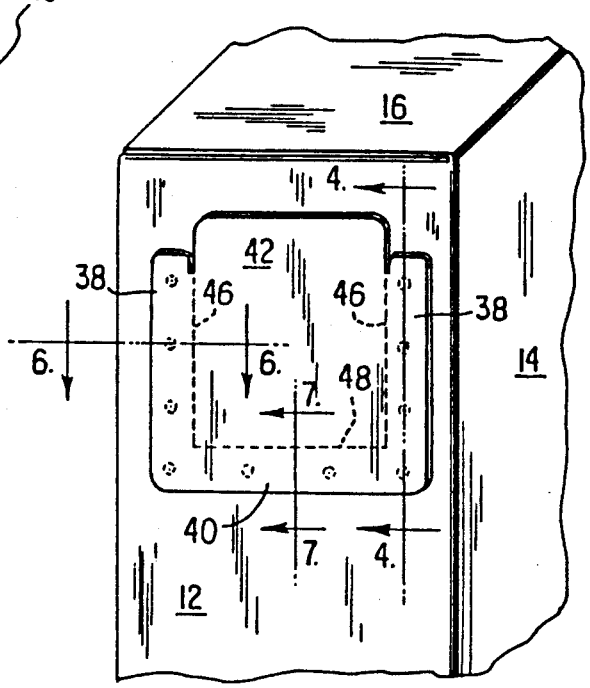
FIG. 2
FIG. 3
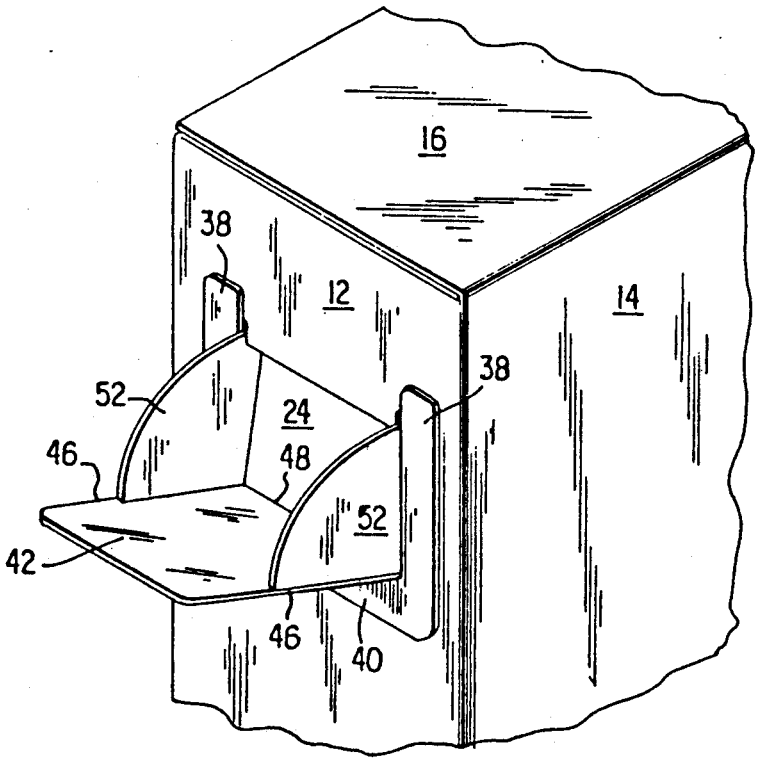

FIG. 4
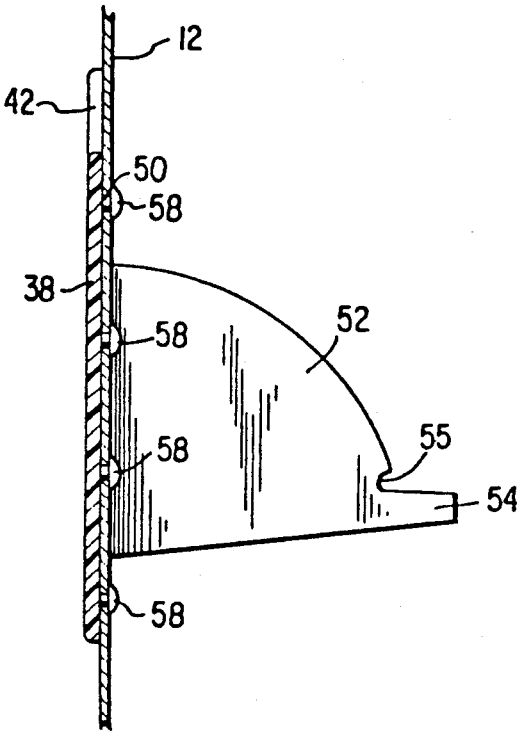
FIG. 5
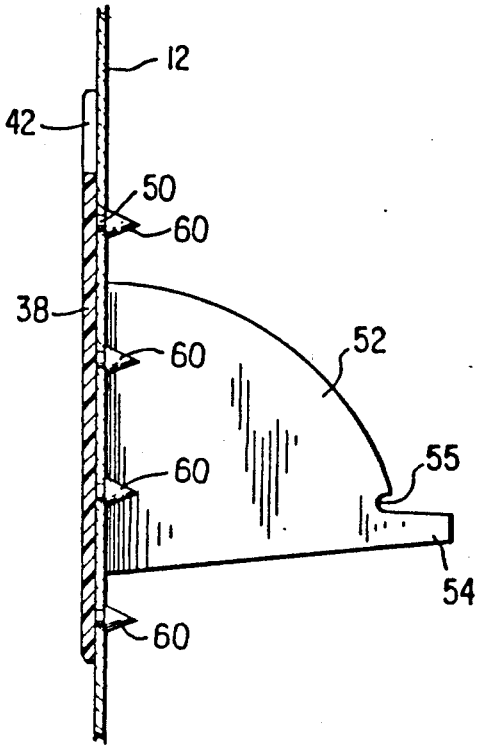
FIG. 6
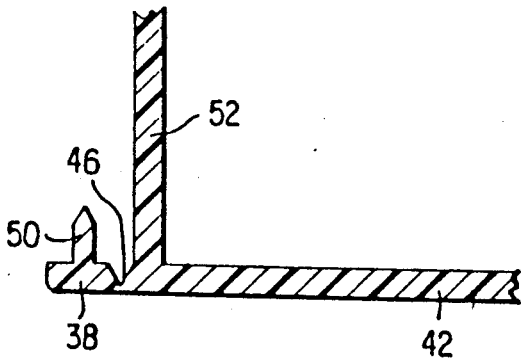
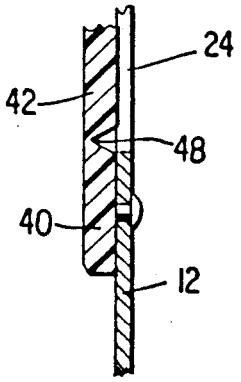
FIG. 7

POUR SPOUT AND CARTON CONSTRUCTION

BACKGROUND OF THE INVENTION

This invention relates to dispensing cartons and, more particularly, to paperboard cartons having a pour spout for dispensing powdered or granular material packaged within the carton.

The dispensing art is aware of a Variety of pour spout and carton constructions, the most commercially common being metal pour spout fixed adjacent a dispensing opening in a paperboard container. While such a construction has been found satisfactory for many types of products to be dispensed, more recent concern over product purity and evidence of tampering generates a need not satisfied by most pour spout and container constructions already known. In certain classes of granular material, such as powdered foodstuffs, there is a danger that particulate metal material may be on the pour spout or other metal portion of the pour spout fitment. Further, some type of auxiliary sealing tape Is often employed to maintain the pour spout in its closed position. Such tapes often yield little or no tamper indication, often being relatively easy to dislodge and to replace.

SUMMARY OF THE INVENTION

According to the practice of this invention, a pour spout and container construction is provided wherein the pour spout and fitment for it is formed of a relatively rigid plastic material, typically a polymer or blends thereof, thereby eliminating the possibility of metal particles contaminating any granular or powdered foodstuff which may packaged in the carton.

Further according to the practice of this invention, the pour spout is frangibly secured in its normal, closed position relative to the fitment. The arrangement is such that, until the initial use by the consumer, the pour spout is maintained in its closed position, thereby preventing accidental opening of the pour spout during shipping or handling prior to final use by the consumer. The particular frangible securement or attachment of the pour spout to its fitment also automatically yields tamper evidence, namely, if the frangible pour spout has been broken away from its normally closed position, the consumer will immediately be apprised of this by inspection of the spout and fitment.

BRIEF DESCRIPTION OF THE DRAWINGS

FIG. 1 is a perspective vie w of an upper corner of a paperboard container provided with a dispensing opening and adapted to receive the pour spout fitment of this invention.

FIG. 2 is a view similar to that of FIG. 1 with the pour spout fitment affixed to the carton in the normal, closed configuration of the spout.

FIG. 3 is a view similar to FIG. 2 showing the pour spout in its open, reclosable confiquration.

FIG. 4 is a view taken along section 4—4 of FIG. 2.

FIG. 5 is a view similar to FIG. 4 and illustrates a modification of the fitment.

FIG. 6 is a View taken along section 6—6 of FIG. 2.

FIG. 7 is a view taken along section 7—7 of FIG. 2.

DETAILED DESCRIPTION OF THE INVENTION

Referring new to the drawings, the numeral 10 denotes generally an upper corner of a typical paperboard carton or container employing the pour spout fitment of this invention. The reader will understand that the container may be fashioned from a variety of blanks, either unitary or composite. The material of the blank is of paperboard or other stiff, resilient and foldable sheet material. The carton 10 includes a first side or end wall forming panel 12, a front (or rear) panel 14, and a top closure 16 which is often defined by two or more overlapping end panels foldably integrally carried by two or more of the side, front and rear panels. The top closure may, however, also be separately formed as by a flanged cap member.

Side wall forming panel 12 is provided with a dispensing opening 24, typically precut, a nd generally of rectangular outline, and having a pair of rectangular excursions or notches 26 at its upper edges. A plurality of puncture holes 28, surround the bottom and sides of dispensing opening 24. The manner of formation of a carton such as that illustrated, as well as its manner of erection and filling with a granular or powdered material, is known in this art and hence will not be described.

Referring now to FIG. 2, the plastic fitment and pour spout (sometimes referred to as a pour spout fitment) of this invention is illustrated as attached to the exterior of side wall 12 of the carton. The fitment can be attached to side wall 12 either before or after the container is set up from its blank.

Referring now to FIGS. 2–7, the plastic fitment includes a flat, generally U-shaped wall having legs 38 and a bight or middle portion 40. The bottom wall of the trough of the dispensing spout is denoted by the numeral 42 and is pivotally and integrally secured to bight 40 along hinge or bend axis 48. The numeral 46 denotes either of two grooves, each of which forms a frangible connection along the sides of the bottom wall 42 and legs 38, to thereby normally secure these elements in fixed and substantially coplanar relationship. The numeral 48 denotes a groove joining the trough bottom wall 42 to the top of bight 40, as viewed in FIG. 2. Groove 48 which defines a hinge axis and grooves 46 are indicated by dashed lines at FIG. 2.

The numeral 52 denotes either of two arcuate side walls of the spout, parallel to each other and extending substantially perpendicular in the same direction from opposite edges of spout bottom 42. A radially projecting stop 54 is provided on the carton's innermost end of each of the arcuate side walls 52. These stops limit the arcuate length of travel of the spout when !t is moved from its closed to its open position.

In a first embodiment of the invention, the interior surfaces of the U-shaped fitment wall 38, 40 are adhesively secured around dispensing opening 24 in sidewall 12. In this embodiment, the puncture holes 28 on the blank are not required.

In use, the consumer grasps the upper edge of the pour spout member 42 and pulls, thereby tearing the frangible connections 46 and permitting the pour spout to pivot open along hinge connection 48 for dispensing of the contents of the container. Thereafter, the pour spout is pivoted and returned to its closed position until product dispensing is again desired. The curved outer edges of spout side walls 52 are received !n and guided and supported by slots 26, thereby maintaining these side walls in parallelism without the need for thick side walls. The spout may be temporarily locked in its open position by notches 55 on the side walls 52 by engaging respective uppermost portion of the rectangular excursion or notches 26. Upon initial opening of the pour spout, the two grooves 46 are ruptured. Upon reclosure, an interference fit is formed between the sides of the spout bottom wall 42 and the legs 38 of the U-shaped wall. This interference or tight snap-fit reclosure arises from the slight permanent elongation or stretching of the plastic at its thinnest portion at grooves 46 upon breaking or tearing. Upon reclosure, these stretched portions will pass one another since the bottom wall 42 is easily pressed slightly beyond legs 38. Thus, the spout bottom wall will lie flat upon reclosure, being substantially coplanar with legs 38, as prior to initial opening.

In the embodiment shown at FIGS. 4 and 6, the interior surfaces of legs 38 and bight portion 40 of the U-shaped wall are provided with perpendicularly extending rivet stakes 50, integral with the U-shaped wall. These stakes are placed in alignment with puncture holes 28, pushed through, and then a heated mandrel is applied to the rivet tips, the U-shaped wall and tips of rivet stakes 50 being urged together, with the result that the heads of rivet stakes become enlarged or swaged, as indicated at 58, to thereby secure the U-shaped fitment wall to the carton sidewall around the dispensing opening. The mode of operation of the pour spout is then the same as that described with respect to the first described embodiment.

Referring now to FIG. 5, another embodiment of the invention is illustrated. The tips of the rivet stakes 50 assume the form of conical arrowheads 60. For assembly, the plastic pour spout fitment is placed onto the outer surface of side wall 12 of the carton, stakes 50 aligned with openings 28, and pushed through into the interior of the carton, so that the arrowheads effect a locking action with side wall 12 and thereby firmly fasten the fitment to the carton. The resiliency of the paperboard permits the openings 28 to expand to permit passage of heads 60, and to then contract to effect the locking or securing action shown at FIG. 7.

A typical thickness of the U-shaped wall 38, 40 and walls 42, 52 is 30 mils, while a typical thickness of the plastic remaining after the formation of the carton interior facing grooves 46, 48 is 2 mils.

What is claimed is:

1. A pour spout and carton construction including a paperboard carton adapted to contain powdered or granular material, said carton having at least one flat wall portion, said flat portion having a dispensing opening therein, a unitary plastic pour spout fitment, said fitment including a generally U-shaped flat wall attached to said carton flat wall portion, a pour spout having a bottom wall and two parallel, curved side walls both extending in the same direction from and perpendicular to said bottom spout wall and toward the carton interior, said bottom wall integrally hinged at one end thereof to the middle portion of said U-shaped flat wall and whose side edges are frangibly secured to the legs of said U-shaped wall by frangible connections, whereby the pour spout bottom wall is normally parallel to said carton flat portion and coplanar with the legs of said U-shaped fitment, whereby the pour spout is openable to permit dispensing by breaking the bottom wall thereof from its frangible connections to the legs of the U-shaped wall, and whereby such breaking is evidence of opening of the pour spout, and means for providing an interference, snap-fit at the edges of the pour spout bottom wall, said means comprising stretched portions of the plastic of the frangible connections upon breaking the frangible connections to thereby enable the spout to be reclosed to substantially its initial position.

2. The construction of claim 1 wherein said fitment is attached to said flat portion by adhesive between the interior surfaces of said U-shaped wall and said flat portion.

3. The construction of claim 1 wherein said fitment is attached to said flat portion by rivet stakes integral with said U-shaped flat wall and which project from said U-shaped wall, said rivets extending through complementary puncture holes in said carton flat portion, the tips of the rivet stakes being enlarged to thereby hold the fitment to said carton flat portion, the tips of said rivet stakes being of conical arrowhead form, the resiliency of the paperboard causing the paperboard to contract around the rivet stake portions which are of smaller diameter than the largest diameter of the conical arrowheads.

4. An integral plastic pour spout fitment comprising a generally U-shaped flat wall, a pour spout having a bottom wall and two parallel, curved edge side walls both extending in the same direction from and perpendicular to said bottom wall, said spout bottom wall integrally hinged to the middle portion of said U-shaped wall, the sides of the spout bottom wall being frangibly connected to the legs of said U-shaped wall by frangible connections, whereby the spout must be broken away from the legs of the U-shaped wall to permit initial swinging of the spout, said U-shaped wall and said spout bottom being substantially coplanar prior to breaking of the frangible connections and means for providing an interference, snap-fit at the edges of the pour spout bottom walls, said means comprising stretched portions of the plastic of the frangible connections upon breaking the frangible connections to thereby enable the spout to be reclosed to substantially its initial position.

5. The fitment of claim 4 wherein the non-hinged end of the bottom pour spout wall extends beyond the free ends of the legs of the U-shaped wall.

6. The fitment of claim 4 wherein the frangible connections comprise a reduction in thickness at the junction of said legs of said U-shaped wall and said pour spout bottom wall.

7. The fitment of claim 4, wherein the bottom wall of the spout is integrally hinged to the bight of said U-shaped wall by a reduction in thickness of said plastic.

* * * * *